US006581407B1

(12) United States Patent
Adiprasito et al.

(10) Patent No.: US 6,581,407 B1
(45) Date of Patent: Jun. 24, 2003

(54) REFRIGERANT COLLECTOR FOR AN AIR CONDITIONING SYSTEM IN A VEHICLE

(75) Inventors: Baroto Adiprasito, Calberlah (DE); Heinz Röhe, Weyhausen (DE)

(73) Assignee: Volkswagen, Wolfsburg (DE)

( * ) Notice: Subject to any disclaimer, the term of this patent is extended or adjusted under 35 U.S.C. 154(b) by 0 days.

(21) Appl. No.: 09/959,863

(22) PCT Filed: Apr. 20, 2000

(86) PCT No.: PCT/EP00/03596

§ 371 (c)(1),
(2), (4) Date: Jan. 25, 2002

(87) PCT Pub. No.: WO00/70277

PCT Pub. Date: Nov. 23, 2000

(30) Foreign Application Priority Data

May 12, 1999 (DE) ..... 199 21 975

(51) Int. Cl.[7] ..... F25B 43/02
(52) U.S. Cl. ..... 62/503
(58) Field of Search ..... 62/503, 470, 471, 62/474, 509, 512

(56) References Cited

U.S. PATENT DOCUMENTS

| | | | | |
|---|---|---|---|---|
| 2,409,928 A | * | 10/1946 | Cahenzli, Jr. | 210/172 |
| 3,488,678 A | | 1/1970 | Wagner | |
| 4,147,479 A | | 4/1979 | Morse | |
| 4,218,890 A | * | 8/1980 | Vakil et al. | 62/114 |
| 4,345,882 A | | 8/1982 | Saito et al. | |
| 4,457,843 A | | 7/1984 | Cullen et al. | |
| 4,474,035 A | | 10/1984 | Amin et al. | |
| 4,702,089 A | * | 10/1987 | Olson | 62/471 |
| 5,177,982 A | | 1/1993 | Plemens | |
| 5,702,023 A | | 12/1997 | Ehs | |
| 5,729,998 A | | 3/1998 | Grohs et al. | |
| 5,778,697 A | | 7/1998 | Wantuck | |

FOREIGN PATENT DOCUMENTS

| | | |
|---|---|---|
| DE | 1 189 568 | 3/1965 |
| DE | 43 14 917 C2 | 11/1993 |
| EP | 0 803 688 A1 | 10/1997 |
| JP | 03194371 | 8/1991 |
| JP | 5-93558 | 4/1993 |
| JP | 07012431 | 1/1995 |

OTHER PUBLICATIONS

German Search Report (partially translated).

* cited by examiner

*Primary Examiner*—William E. Tapolcai
(74) *Attorney, Agent, or Firm*—Rabin & Berdo, PC

(57) ABSTRACT

A refrigerant accumulator (1) for a vehicle air-conditioning system comprises and upper and a lower half-shell (5, 6), which are connected to one another by a welded seam (7).

20 Claims, 1 Drawing Sheet

REFRIGERANT COLLECTOR FOR AN AIR CONDITIONING SYSTEM IN A VEHICLE

BACKGROUND OF THE INVENTION

The invention relates to a refrigerant accumulator for a vehicle air-conditioning system. In particular, it concerns a refrigerant accumulator for receiving and releasing a liquid refrigerant within the scope of a cooling process of a vehicle air-conditioning system having special properties for high operating pressures, especially for the operation of a vehicle air-conditioning system that utilizes $CO_2$ as the refrigerant.

It is known that, in the dynamic operation of a vehicle air-conditioning system, a non-evaporated, liquid refrigerant can appear on the outlet side of an evaporator; this refrigerant must be kept in interim storage and only supplied to the downstream components, such as intermediate heat exchangers, in small quantities to avoid damaging the compressor. A corresponding refrigerant accumulator is described in, for example, U.S. Pat. No. 5,245,836 by Lorentzen et al., issued on Sep. 21, 1993.

The known, described refrigerant accumulators are cylindrical, however, and are produced with special connector ends, such as arched dished ends. This construction results in a large mass and large dimensions with high operating pressures. Furthermore, numerous welded seams must be created for securing the connector end; it has been seen that, due in part to the large number of these seams, they may have weak points. Large dimensions and masses also preclude the use of these refrigerant accumulators in compact vehicles.

SUMMARY OF THE INVENTION

It is therefore the object of the invention to provide a refrigerant accumulator of the type mentioned at the outset, which is highly resistant to pressure and has a low mass, and can be produced simply with technically simple means.

This object is accomplished by a refrigerant accumulator of the type mentioned at the outset, which comprises an upper and a lower half-shell that are connected to one another by a welded seam.

This not only reduces the dimensions and the mass of a refrigerant accumulator, but also shortens the production time, because only a single welded seam must be created.

Because only one welded seam is to be created, the risk of a weak point in the welded seam decreases; a single welded seam can be checked significantly more simply and quickly.

The two half-shells can be concave or semi-spherical, and vertically superposed.

The concave or semi-spherical embodiment of the lower half-shell advantageously allows separated liquid to run together in the lowest point of the container.

The two half-shells can be made of plastic or metal; metal half-shells can withstand a higher pressure.

In an advantageous embodiment of the invention, the upper half-shell has a separator pipe, which is guided through the wall of the upper half-shell and, on an intake side, is provided with a pipe connector located outside of the upper half-shell.

If the end of the separator pipe is bent laterally inside the refrigerant accumulator, it is advantageously possible to convey the medium entering in jet form to the inside wall of the refrigerant accumulator, and separate the liquid components there. This also prevents separated liquid in a li quid sump from foaming due to the incoming jet flow.

If the upper half-shell also has a pipe connector for a mixing pipe on an outlet side, with the pipe extending through the lowest region of the lower half-shell and back into the upper half-shell, it is no longer possible for the incoming medium to enter the mixing pipe.

If the mixing pipe in the lowest region of the lower half-shell has at least one pipe bore that leads to the wall of the lower half-shell, it is possible to suction off virtually all of the separated refrigerant.

In a further advantageous embodiment, the mixing pipe has at least one bore above the maximum anticipated level of a liquid sump. This assures the known accumulator function of forming a mixture of liquid and gaseous media at the outlet.

In accordance with a further advantageous embodiment of the invention, the respective diameters of the at least one pipe bore and the at least one bore are dimensioned such that a mixing ratio of the liquid mass drawn from the liquid sump to the gas mass that has been flowed through is formed virtually independently of the mass throughput through the mixing pipe.

BRIEF DESCRIPTION OF THE DRAWINGS

Further features and advantages of the invention ensue from the following description of an exemplary embodiment, with reference to the drawings.

Shown are in.

Figure 1:
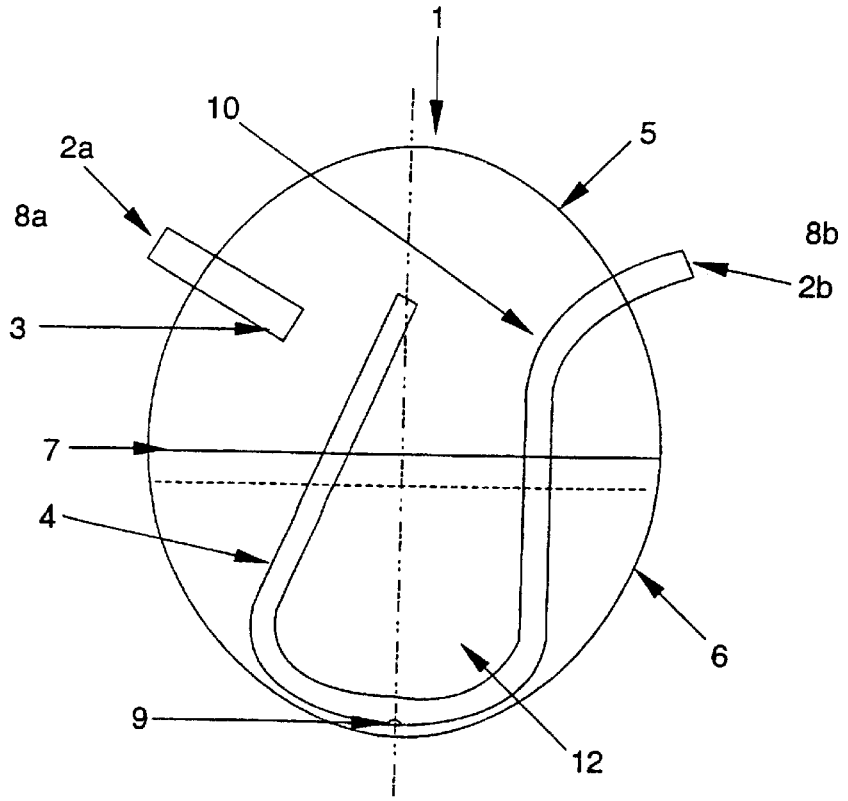
FIG. 1 a cross-section, in the vertical direction, through a refrigerant accumulator.
Figure 2:
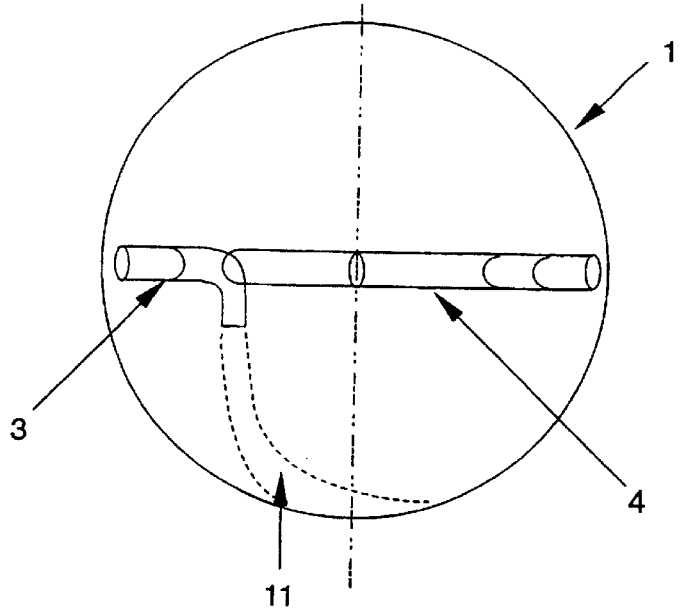
FIG. 2 a cross-section, in the horizontal direction, through the refrigerant accumulator according to FIG. 1.

As can be seen in the figures, a refrigerant accumulator 1 comprises two concave or semi-spherical half-shells 5 and 6, namely an upper half-shell 5 and a lower half-shell 6; these are connected to one another by a single welded seam 7 to form an ellipsoid shape.

The concave embodiment of the lower half-shell 6 advantageously allows separated liquid to run together at the lowest point of the refrigerant accumulator 1.

One end of a separator pipe 3 is guided through the wall of the upper half-shell 5 and connected to a pipe connector 2*a* on an intake side 8*a*.

One end of a mixing pipe 4 is guided through the wall of the upper half-shell 5 and connected to a pipe connector 2*b* on an outlet side 8*b*.

This mixing pipe 4 is guided downward from the pipe connector 2*b* to the lowest region or lowest point of the lower half-shell 6, and from there back into the upper half-shell 5.

One or a plurality of pipe bores 9 is advantageously cut into a lower curved region of the mixing pipe 4. It is therefore possible for a bore opening to be located at the lowest point of the pipe curve of the mixing pipe 4, at a short distance above the lowest point of the floor of the lower half-shell 6. In this way, the separated refrigerant is virtually completely sectioned off.

The mixing pipe 4 advantageously has a further bore 10, which is located above a maximum anticipated liquid level.

The pipe bore 9 and the bore 10 ensure the known refrigerant-accumulator function of forming a mixture of liquid and gaseous media at the outlet 8*b*.

Moreover, the end of the pipe segment 3 located inside the refrigerant accumulator 1 is advantageously bent to the side.

This prevents an incoming medium 11 from entering the mixing pipe 4, allows the medium 11 entering in jet form to flow to the inside wall of the refrigerant accumulator 1, thereby allowing the liquid components to be separated, and prevents separated liquid from foaming in a liquid sump 12 due to the entering jet flow.

The respective diameters of the pipe bore 9 and the bore 10 of the mixing pipe 4 can be dimensioned such that a mixing ratio of the liquid mass drawn from the liquid sump 12 to the gas mass flowing through is formed virtually independently of the mass throughput through the mixing pipe 4.

What is claimed is:

1. A refrigerant accumulator for a vehicle air-conditioning system, comprising:

an upper and a lower half-shell, which are connected to one another by a welded seam, wherein the two half-shells respectively have an essentially semicircular cross-section.

2. The refrigerant accumulator according to claim 1, wherein the two half-shells are semi-spherical.

3. The refrigerant accumulator according to claim 1, wherein the half-shells comprise plastic or metal.

4. The refrigerant accumulator according to claim 1, wherein the upper half-shell has a separator pipe that is guided through a wall of the upper half-shell, and is provided with a pipe connector on an intake side, the connector being located outside of the upper half-shell.

5. The refrigerant accumulator according to claim 4, wherein an end of the separator pipe is bent laterally inside the refrigerant accumulator.

6. The refrigerant accumulator according to claim 1, wherein the upper half-shell has a pipe connector for a mixing pipe on an outlet side, the mixing pipe being led through a lowest region of the lower half-shell and back into the upper half-shell.

7. The refrigerant accumulator according to claim 6, wherein, in the lowest region of the lower half-shell, the mixing pipe has at least one pipe bore, which leads to a wall of the lower half-shell.

8. The refrigerant accumulator according to claim 7, wherein the mixing pipe has at least one bore above a maximum anticipated level of a liquid sump.

9. The refrigerant accumulator according to claim 8, wherein the respective diameters of the at least one pipe bore and the at least one bore are dimensioned such that a mixing ratio of a liquid mass drawn from the liquid sump to a gas mass that has been flowed through is formed virtually independently of a mass throughput through the mixing pipe.

10. The refrigerant accumulator according to claim 2, wherein the half-shells comprise plastic or metal.

11. The refrigerant accumulator according to claim 2, wherein the upper half-shell has a separator pipe that is guided through a wall of the upper half-shell, and is provided with a pipe connector on an intake side, the connector being located outside of the upper half-shell.

12. The refrigerant accumulator according to claim 3, wherein the upper half-shell has a separator pipe that is guided through a wall of the upper half-shell, and is provided with a pipe connector on an intake side, the connector being located outside of the upper half-shell.

13. The refrigerant accumulator according to claim 10, wherein the upper half-shell has a separator pipe that is guided through a wall of the upper half-shell, and is provided with a pipe connector on an intake side, the connector being located outside of the upper half-shell.

14. The refrigerant accumulator according to claim 2, wherein the upper half-shell has a pipe connector for a mixing pipe on an outlet side, the mixing pipe being led through a lowest region of the lower half-shell and back into the upper half-shell.

15. The refrigerant accumulator according to claim 3, wherein the upper half-shell has a pipe connector for a mixing pipe on an outlet side, the mixing pipe being led through a lowest region of the lower half-shell and back into the upper half-shell.

16. The refrigerant accumulator according to claim 4, wherein the upper half-shell has a pipe connector for a mixing pipe on an outlet side, the mixing pipe being led through a lowest region of the lower half-shell and back into the upper half-shell.

17. The refrigerant accumulator according to claim 5, wherein the upper half-shell has a pipe connector for a mixing pipe on an outlet side, the mixing pipe being led through a lowest region of the lower half-shell and back into the upper half-shell.

18. A refrigerant accumulator, comprising:

an upper half shell; and a lower half shell joined directly to the upper half shell using a single seam, the upper half shell and the lower half shell each having an essentially semicircular cross-sectional profile so that when the upper half shell and the lower half shell are directly joined together, the upper half shell and the lower half shell collectively form an ellipsoid shape.

19. The refrigerant accumulator recited in claim 18, further comprising a mixing pipe that is respectively led from the upper half shell, through a lowest region of the lower half shell and back into the upper half shell, the mixing pipe having a first bore in a lowest region of the lower half shell which opens toward a wall of the lower half shell, and a second bore above a maximum anticipated level of a liquid sump.

20. The refrigerant accumulator recited in claim 19, wherein the respective diameters of the first bore and the second bore are dimensioned such that a mixing ratio of a liquid mass drawn from the liquid sump to a gas mass that has been flowed through is formed virtually independently of a mass throughput through the mixing pipe.

* * * * *